United States Patent [19]

McKeever

[11] 4,019,362

[45] Apr. 26, 1977

[54] TERMINAL CRIMPING MACHINE

[75] Inventor: Carl W. McKeever, Kendallville, Ind.

[73] Assignee: Lyall Electric, Inc., Albion, Ind.

[22] Filed: Mar. 17, 1975

[21] Appl. No.: 559,336

[52] U.S. Cl. ..... 72/421; 72/413; 72/481; 29/753; 83/229; 83/278; 226/167

[51] Int. Cl.[2] ..... B21D 37/04; B21D 43/04

[58] Field of Search ..... 72/421, 481, 482, 413, 72/417, 405; 29/203 D, 203 DS, 203 DT; 83/229, 278; 226/158, 162, 167

[56] References Cited

UNITED STATES PATENTS

| | | | |
|---|---|---|---|
| 2,779,590 | 1/1957 | Seastrom | 83/278 X |
| 2,876,452 | 3/1959 | Herman et al. | 29/203 DT |
| 3,037,545 | 6/1962 | Klingler et al. | 29/203 DS |
| 3,066,717 | 12/1962 | Lynch, Jr. | 72/481 X |
| 3,184,950 | 5/1965 | Sitz | 29/203 DS |
| 3,289,446 | 12/1966 | Davey | 72/481 X |
| 3,390,567 | 7/1968 | Frastaci | 83/278 X |
| 3,398,567 | 8/1968 | Olsson | 29/203 DT X |
| 3,548,479 | 12/1970 | Netta et al. | 29/203 DS |
| 3,628,228 | 12/1971 | van de Kerkhof | 29/203 DS |
| 3,673,847 | 7/1972 | van de Kerkhof | 29/203 DS |
| 3,745,807 | 7/1973 | Vogel et al. | 29/203 DT |
| 3,813,753 | 6/1974 | Miller | 29/203 DT |

*Primary Examiner*—C.W. Lanham

*Assistant Examiner*—D. M. Gurley

*Attorney, Agent, or Firm*—Gust, Irish, Jeffers & Rickert

[57] ABSTRACT

A machine for attaching terminals to electrical conductors is disclosed wherein the bed and ram of an applicator are relatively movable together and apart and each carries a cooperating one of a pair of crimping dies to crimp a terminal onto a conductor when the ram and bed are moved together. A terminal feeding device supplies terminals to be crimped by the dies seriatim and in synchronism with relative movement between the ram and bed and a unidirectional coupling such as a chain connects the terminal feeding device to the ram so that the feeding device is actuated to supply a terminal when the ram retracts from the bed. A spring biasing device opposes operation of the unidirectional coupling to restore the feeding device for subsequent actuation. The cooperating dies and terminal feeding device are independently removably attached to the machine allowing independent replacement to accommodate specific conductor-terminal combinations. The terminal feeding device is independently relocatable to accommodate strip formed terminals designed to be fed into the crimp die area from the left, right or rear direction.

4 Claims, 11 Drawing Figures

FIG. 3
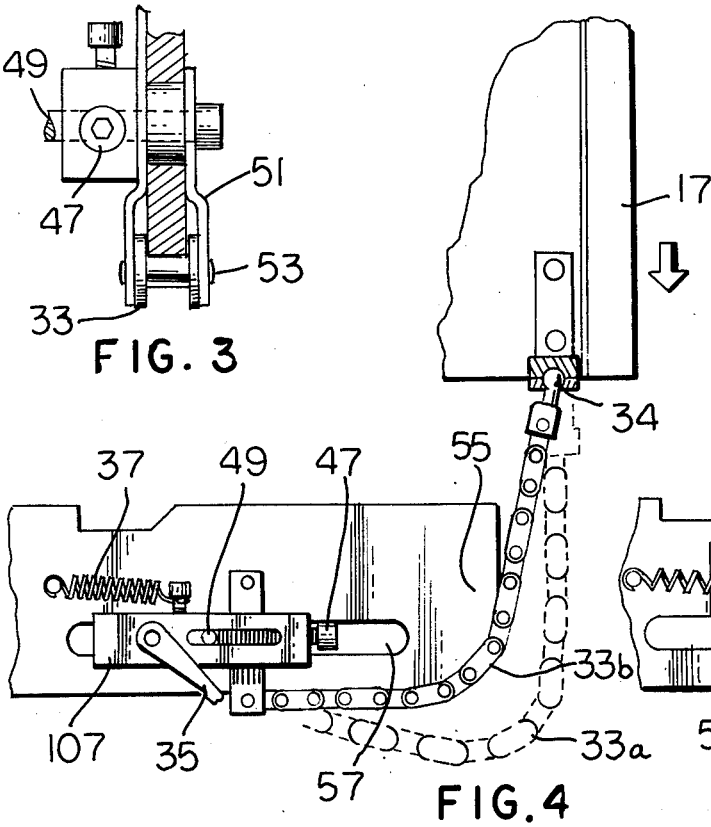
FIG. 4
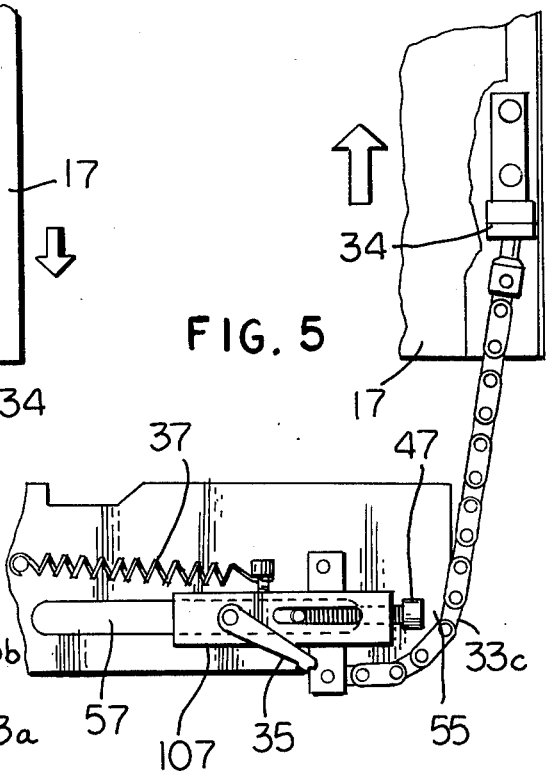
FIG. 5
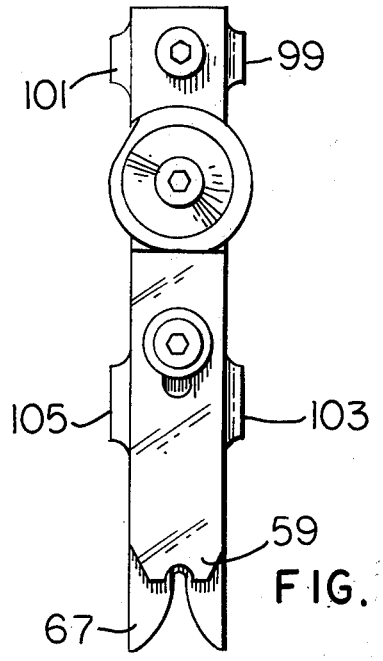
FIG. 6
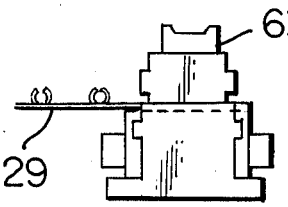
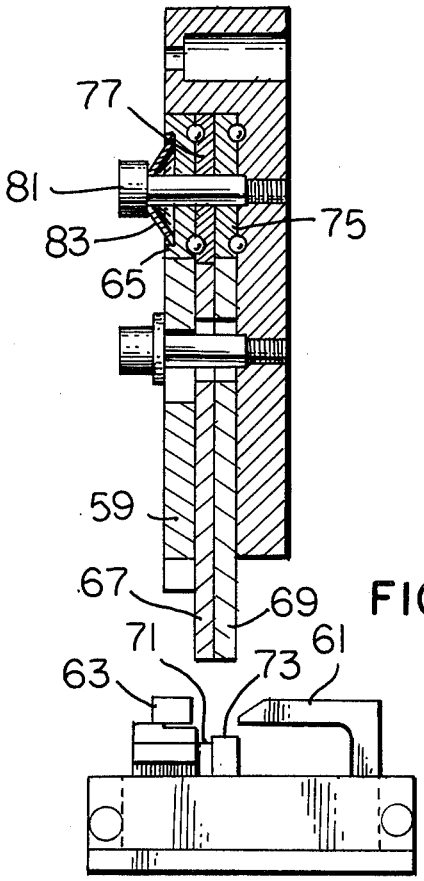
FIG. 7

TERMINAL CRIMPING MACHINE

BACKGROUND OF THE INVENTION

The present invention relates generally to terminating machines and more specifically to applicators for crimping terminals onto electrical conductors.

Numerous schemes and equipments for mechanically crimping terminals to conductors are known in the prior art. Typical of such schemes are individual applicator units as exemplified by U.S. Pat. Nos. 3,184,950 and 3,191,411. Such applicator units are an integral structure including a connector feeding device and a reciprocable ram for moving one or more punches or one or more dies to effect the crimping of the terminal to the conductor. Such integral units are used in conjunction with general purpose bench presses and, when it is desired to change from the crimping of one type terminal to the crimping of a different type terminal, the entire applicator unit must be removed from the bench press and another suitable applicator unit substituted therefor.

Numerous terminal feeding schemes are also known employing air cylinders, mechanical linkages or spring feeding coupled with a mechanical linkage to retract the feeding device when the ram moves toward the anvil thus compressing the spring for the next terminal advance. Such feeding schemes are exemplified by U.S. Pat. Nos. 3,030,694; 3,191,411 and 3,359,780.

The dies for crimping the terminal have also sometimes been deployed in bench presses in a removable manner as illustrated by U.S. Pat. Nos. 3,091,276 and 3,398,567; however, such structures do not readily allow quick replacement of the elements.

SUMMARY OF THE INVENTION

Among the several objects and advantages of the present invention may be noted the provision of a crimping machine characterized by its economies of manufacture, use and conversion to differing crimping tasks; the provision of a crimping machine having a unique terminal feeding system; the provision of a crimping machine having individual removable terminal feed mechanism and crimping dies; the provision of a crimping machine which is easily accommodated to any specific conductor-terminal combination with reduced conversion down time; and the provision of a unitary crimping machine providing the versatiltiy and accuracy of a standard press with replaceable applicators.

In general and in one form of the present invention a crimping machine includes a powered applicator having a bed and ram respectively supporting cooperating crimping dies and relatively movable together and apart to crimp a terminal onto a conductor. A terminal feeding device supplies terminals in series and in synchronism with relative movement of the ram and bed to the region therebetween for crimping and a unidirectional device couples the terminal feeding device to the press for supplying a terminal to the region between the dies when the bed and ram move apart. Biasing means is provided to restore the feeding device for subsequent actuation by the unidriectional device.

Also in general a crimping machine has individually removable crimping dies affixed respectively to the bed and ram of the applicator along with a removable terminal feeding structure thereby allowing independent replacement of any of the crimping dies and feeding structure to accommodate specific conductor-terminal combinations, said parts all being replaceable without the need of tools.

Also in general a crimping machine has an independently relocatable feeding device adaptable to feed terminals into the crimping dies from any of three quadrants.

BRIEF DESCRIPTION OF THE DRAWINGS

FIG. 3 is a side elevation view of a portion of the terminal feed device including a portion of the unidirectional force transmitting chain;

FIG. 4 is a front elevational view of the terminal feed device including the chain and a portion of the applicator ram;

FIG. 5 is a front elevation similar to FIG. 4 but illustrating the terminal advanced position;

FIG. 6 is a front elevation view illustrating the cooperating crimping dies contained in their respective tool holders;

FIG. 7 is a side view in section of the structure of FIG. 6;

Corresponding reference characters indicate corresponding parts throughout the several views of the drawing.

The following examples illustrate the invention and are not to be construed as limiting in any manner.

Figure 1:
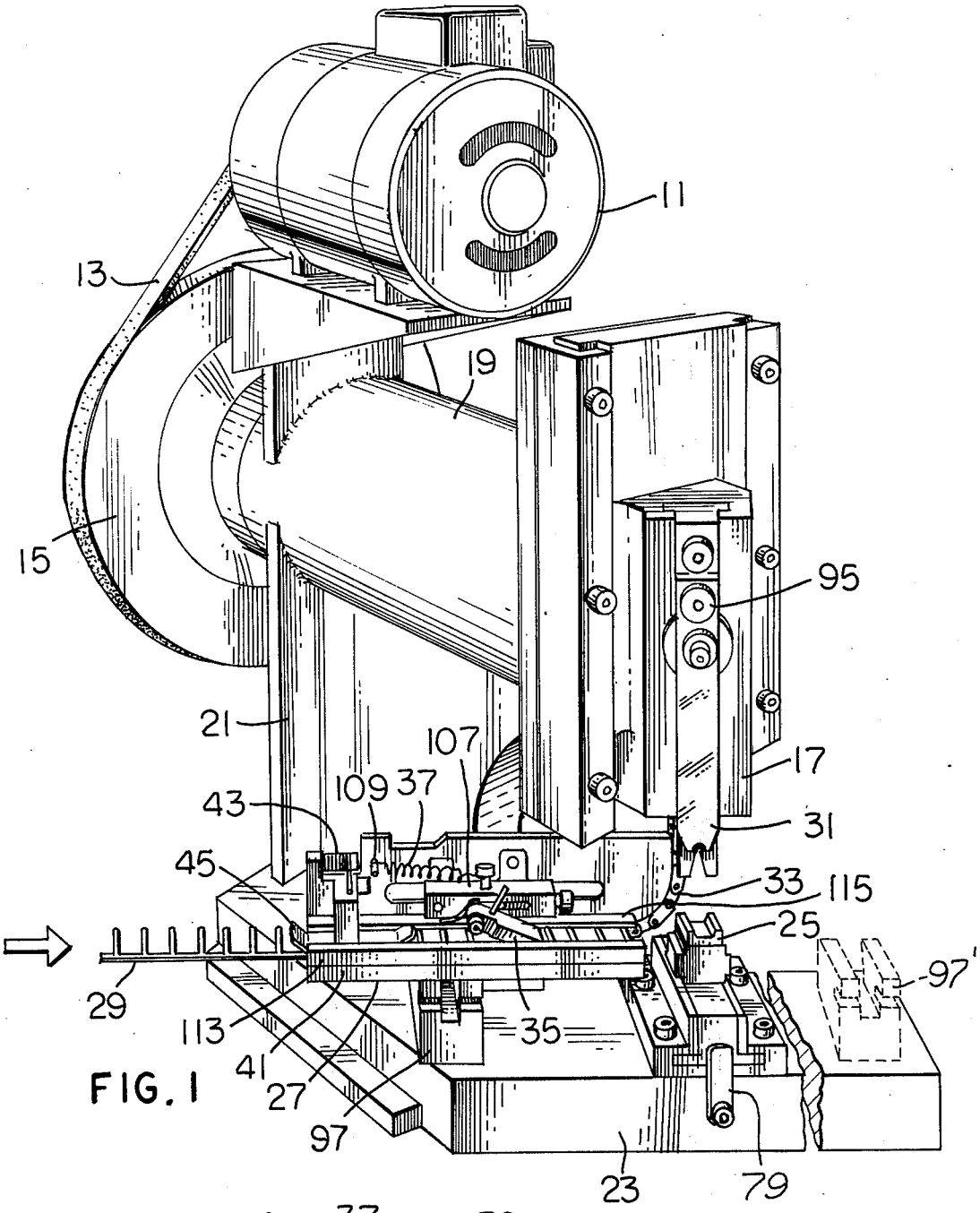
FIG. 1 is a perspective view of a crimping machine according to the present invention.

Referring now to the drawing in greater detail, the perspective view of FIG. 1 shows a machine for crimping terminals to electrical conductors having as its power source the electric motor 11 coupled by way of drive belt 13 to a fly wheel clutch assembly 15. An applicator ram 17 is reciprocably driven by rotation of an eccentric disc on a drive shaft which passes along the drive shaft housing 19 causing one complete down and up cycle of the applicator ram when the clutch of assembly 15 is actuated. A scotch yoke arrangement may be used to convert the rotary to reciprocating motion. Clutch actuation may be by a solenoid coupled operator foot switch and conductors may be placed by hand into the crimp area of the terminal or the operation may be automated. The applicator frame 21 has a bed 23 supporting an anvil 25 and a terminal feed device 27 through which the terminal strip 29 is fed to the region between the anvil 25 and the ram 17. The anvil 25 constitutes one of a pair of crimping dies 25 and 31 which cooperate upon relative movement together of the bed 23 and ram 17 to crimp a terminal onto a conductor. The dies 25 and 31 as well as the terminal feed device 27 are individually removable from the press allowing indpendent replacement necessitated by wear of any one or more of these elements or to accommodate a specific conductor-terminal combination. Terminals are supplied seriatim and in synchronism with the relative movement of the ram and bed because the terminal feed device 27 is actuated by a flexible nonelastic tension transmitting member such as the chain 33 which functions to unidirectionally couple the feed device to the ram to pull a pusher or pawl 35 to the right as viewed to present the next terminal to the crimping dies when the applicator ram raises. The chain may connect to the ram by a swivel 34 to allow for changing the direction or quadrant from which terminals are fed. When the ram 17 descends for a crimping operation, a biasing device such as the spring 37, which opposed operation of the chain 33, restores the feed device for subsequent actuation by the unidirectional coupling chain 33. The distance moved by the pawl 35 may of course be less than the distance moved by the ram 17 with this difference being represented by simple slack in the chain 33.

Figure 2:
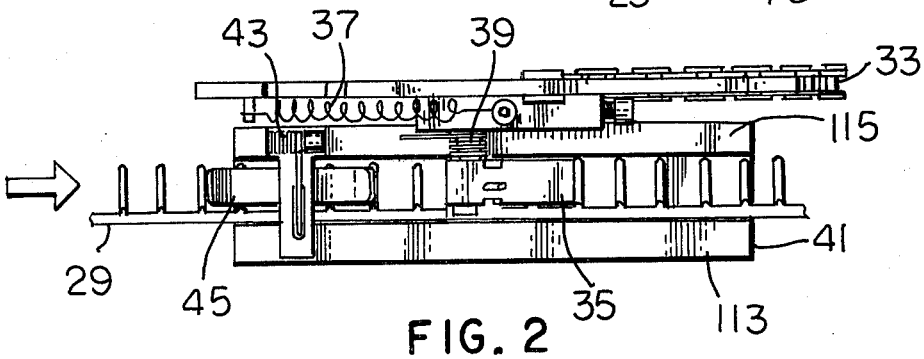
FIG. 2 is a top view of the terminal feed device of FIG. 1.
Figure 8:
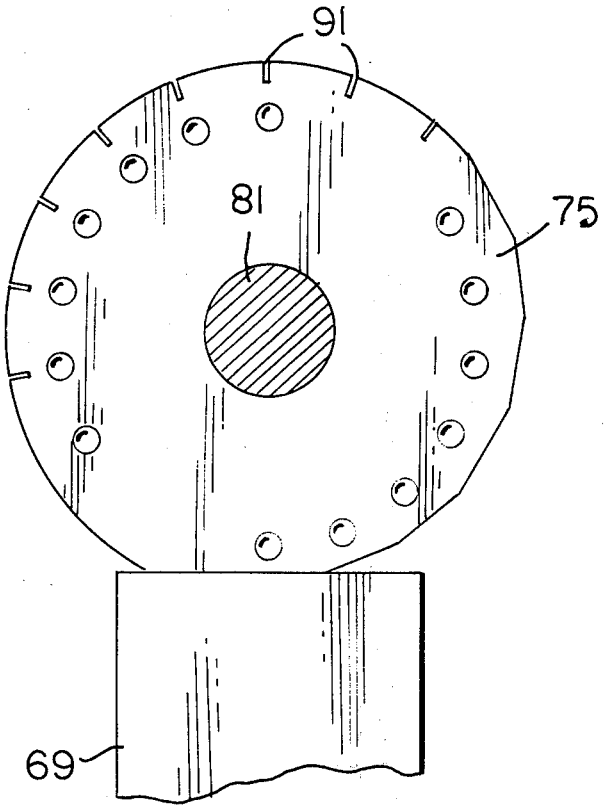
FIG. 8 is a rear elevation view illustrating the manner of varying die separation for wire crimping.
Figure 9:
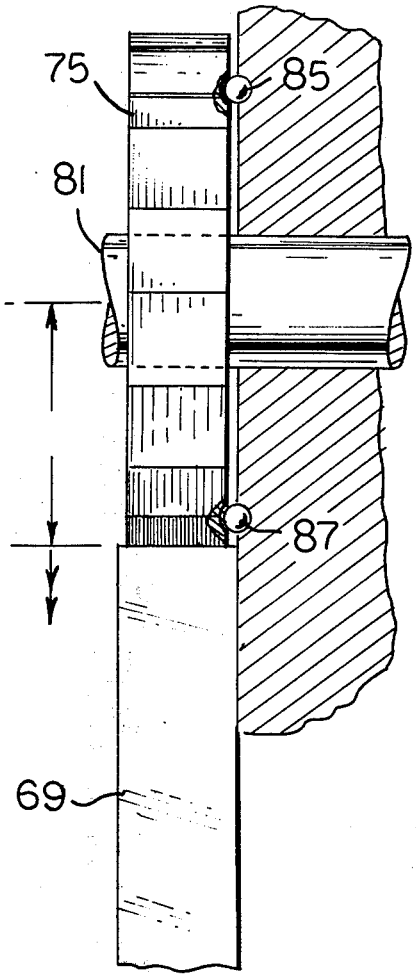
FIG. 9 is a side sectional view of the structure of FIG. 8.
Figure 10:
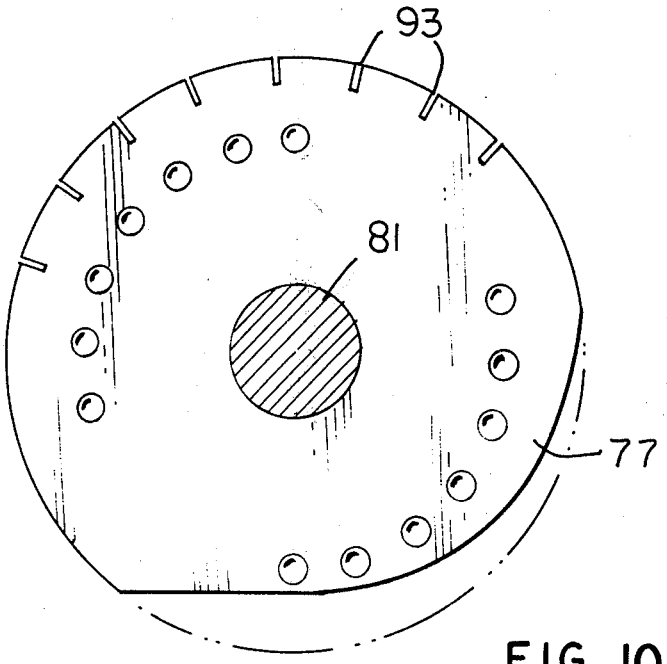
FIG. 10 is a front elevation similar to FIG. 8 showing structure for independently varying the die separation for insulation crimping.

As seen in FIG. 2, the pusher or pawl 35 engages the strip of terminals 29 to advance one terminal for each cycle of the ram 17. The pawl 35 is spring loaded by the coil spring 39 so that rightward movement of the pusher 35 engages the strip 29; however, when the ram descends and the chain 33 becomes slack, return spring 37 moves the pawl 35 leftwardly as viewed and the pawl rides overtop an individual terminal preparatory to the next cycle. The terminal feed base 41 is of course stationary relative to the applicator bed 23 as is the hold down spring 43 and the shoe 45 which, due to the pressure of the hold down spring 43, holds the terminal strip 29 in its track in the base 41.

Figure 11:
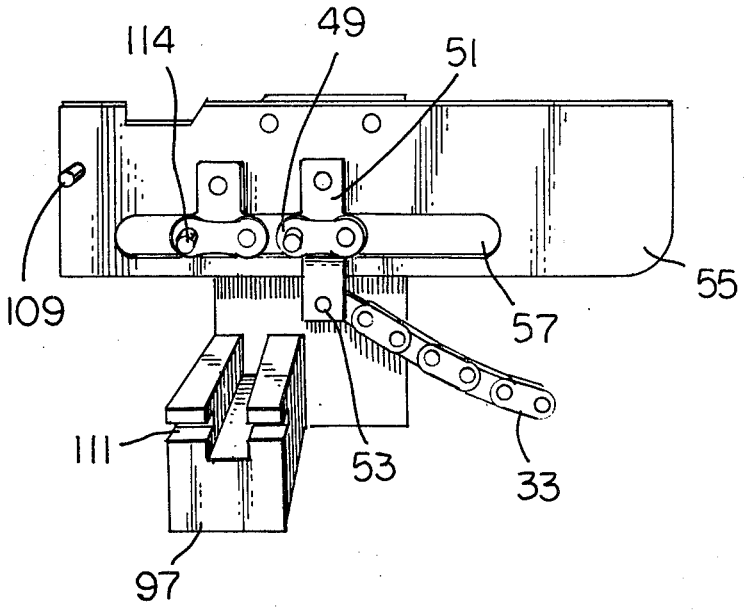
FIG. 11 illustrates the feed mechanism partially disassembled.

Comparing FIGS. 4 and 5, when the ram 17 is completely down, the chain assumes a slack position **33*a* and the pawl 35 is pulled as far to the left by the spring 37 as the position of a fixed stop will allow. The amount of slack in the chain and therefore also the time in the upward travel of the ram 17 at which the chain begins to pull the slide (portions of the feed device which move during the advance of a terminal) may be varied by the setting of the adjustment screw 47 one end of which engages the pin 49. As seen in FIGS. 3 and 11 this pin 49 passes through a linkage 51 which in turn is attached to the chain 33 by a second pin 53. As the ram 17 continues upwardly the chain slack is removed as at 33*b* and continued upward movement of the ram 17 pulls the slide and, by way of pawl 35, the terminal strip a distance equal to the remaining upward travel of the ram 17. Withdrawing the adjustment screw 47 would of course reduce the travel of the slide. Continued upward movement of the ram 17 extends the spring 37 supplying a terminal to the dies as illustrated in FIG. 5. At the top of the ram cycle the chain is positioned at 33*c* and thereafter downward ram travel allows the spring 37** to pull the slide leftwardly to the fixed stop after which slack again appears in the chain.

Since chain 33 is capable of transmitting only tension it or any other flexible nonelastic tension transmitting member such as a steel cable requires a translator from the vertical direction of ram motion to the horizontal direction of slide motion and this is provided by the chain guide 55 which could be a sprocket like device however the simple rounded corner about which the chain may be pulled as illustrated has proven suitable. Continued reciprocation of the ram 17 of course results in continued reciprocation of the slide in synchronisn with the ram and the supply of a series of terminals to the dies. The slide is of course supported in the elongated slot 57 during its reciprocating motion.

The ram 17 supports a punch or one member of the pair of dies and the details of the punch or punches and their manner of adjustable support is illustrated in FIGS. 6–10. In FIGS. 6 and 7 the punch arrangement includes two different dies for crimping the terminal to both the conductor and around the insulation as is known in the art but of course a single die might be employed in some circumstances. The multiple dies of FIGS. 6 and 7 are illustrative of the variations possible with the present invention. For example, if the terminal strip has front and rear interconnecting strip material portions, (carrier strips) the arrangement of FIG. 7 would provide a front cut off die 63 and a rear cut off die (not shown) which would cooperate respectively with anvil portions to sever an individual terminal from the strip. The cut off die 63 differs in design from the crimping dies in that both die halves are mounted on the bed with the ram supported portion or depressor 59 functioning to force the die portions together against a normal spring bias separating the portions. The depressor 59 and die 63 are each centrally undercut to allow the presence of the conductor passing therebetween during applicator actuation.

Punches 67 and 69 would cooperate respectively with anvil portions 71 and 73 to crimp the terminal about the insulation and about the conductor respectively. The insulation and conductor crimping punches 67 and 69 may be arranged for independent adjustment to vary their respective degree of crimp by providing a conductor crimp control cam 75 illustrated in greater detail in FIG. 8 and insulation crimp control cam 77 illustrated in greater detail in FIG. 10.

Arm 61 functions as a guide to hold free terminal ends down during crimp and a further cam 65 may be provided to adjust cut-off actuator 59 if desired.

To adjust the relative positions of the two punches, the respective cams 75 and 77 may be rotated about the axis of cap screw 81 to vary the distance between those punches and the axis of cap screw 81. These cams may be rotated through several detent positions as provided by the spring tension of washer 83 in cooperation with alignable recesses and detent balls such as 85 and 87 of FIG. 9. Notches such as 91 and 93 may be provided about all or part of the periphery of the two cams for easy movement of those cams for example by the insertion of a screwdriver tip.

One or more of the crimping dies and/or the feed mechanism may be easily replaced without the need of tools to accommodate a different terminal and conductor combination. Returning to FIG. 1, the punch portions of the crimping dies are removably affixed to the applicator ram for example simply by holding the punch assembly in a preformed slot in the ram by the spring loaded pin 95. The portion of the feed mechanism including the shoe 45, and spring 43 and base 41 as well as the pusher 35 and pusher spring 39 may be assembled in a direction transverse to the feed direction with base 41 being inserted into a slotted structure 97 affixed to the applicator bed. The removable portion, that is, the tool and tool holder, may be held in the slotted structure by release spring mechanisms, ball detents or by friction fit or a roll pin in a cooperating slot. The anvil portion of the crimping dies and their tool holder may similarly be held in a slotted structure on the press bed for example by ball detents, a simple pivotable block 79 or otherwise as desired making each of these three structures easily removably affixed to the press.

More specifically, the illustrated embodiment provides for the quick removal and replacement of punches by utilizing the lips or tabs 99, 101, 103 and 105 in conjunction with a pair of corresponding cut-away portions leading to a vertically extending pair of slots within the ram 17 so that the punch may be laterally displaced into the vertically extending slots with the tabs 99 and 101 passing through the corresponding cut-away portions and the tabs 103 and 105 lying beneath the lowermost portion of the ram 17. The punch is then displaced upwardly in its track until the spring loaded plunger 95 falls into a corresponding aperture in the ram 17 to firmly hold the punch in place.

Details of the removal of the feed mechanism may be seen by comparing FIGS. 1, 2, 3, 4 and 11. The base 41 is frictionally held in position by a pin which extends in the direction of terminal feed and frictionally engages the slot 111. The base 41 is removed by simply lifting the pawl 35 and pulling the base in a direction perpendicular to that of terminal feed. The shoe 45 and hold down spring 43 come off with the base 41. The block 107 which supports the pawl 35 may then be pulled off its two support pins 49 and 114 by simply disconnecting the spring 37 from the stud 109. At this point in time the feed mechanism appears as depicted in FIG. 11 and may be removed from the bed 23 and further disassembled as desired. It will be noted that virtually all the parts of the feed device 27 are symmetrical and therefore with a minimum of additional parts the feed device could be reassembled in a mirror image manner and mounted as illustrated by the dotted slotted structure 97' to the right of the punch as viewed in FIG. 1 to feed terminals in the opposite direction from that depicted. In accomplishing this, rails 113 and 115 would be unbolted from the base 41 and reattached to the opposite side thereof and, of course, the slide's supporting pins 114 and 49 would be removed from the slot 57 reversed and reinserted into that slot. The swivel 34 connecting the chain 33 to the ram 17 of course facilitates this reversal of feed direction. It would also be clearly within the scope of the present invention to provide for a similar feeding of terminals from the rear, that is, in the direction directly opposite the direction from which the wire is placed in the punch working area.

By providing independently replaceable dies and feeding structure weight and expense are reduced when compared to the typically employed general purpose bench press and applicator unit which has its own slides and guidance system over and above those of the general purpose press.

Thus while the present invention has been described with respect to a specific preferred embodiment numerous modifications will suggest themselves to those oridinarily skilled in the art and accordingly the scope of the present invention is to be measured only by that of the appended claims.

I claim:

1. A crimping machine for attaching terminals to electrical conductors comprising:

an applicator having a bed and a ram relatively movable together and apart to operate on a workpiece placed therebetween;

first and second cooperating crimping dies operable by relative movement together of the ram and bed to crimp a terminal onto a conductor, the first crimping die being removably attached to the applicator ram and the second crimping die being removably attached to the applicator bed;

terminal feed means removably attached to the applicator and including a reciprocating member for supplying terminals seriatim and in synchronism with the relative movement of the ram and bed, to the region between the ram and bed and only during motion of the reciprocating member in one direction;

flexible, nonelastic tension transmitting means coupling the feed means and applicator to actuate the feed means to supply a terminal to the region between the ram and bed when the ram and bed move apart; and biasing means opposing operation of the flexible nonelastic tension transmitting means to restore the feed means for subsequent actuation by the flexible nonelastic tension transmitting means, the biasing means including a feed means restoring spring and the flexible nonelastic tension transmitting member interconnecting the ram and the feed means reciprocating member to deform the restoring spring and deliver a terminal when the ram moves away from the bed, the distance moved by the reciprocating member being less than the extent of relative motion between the bed and ram with the flexible nonelastic tension transmitting means going slack between reciprocations of the reciprocating member.

2. The crimping machine of claim 1 wherein said feed means may be located in any of three quadrants relative to the crimping dies to provide for feeding terminals from one of the three quadrants.

3. The crimping machine of claim 1 wherein the flexible nonelastic tension transmitting means assumes a slack position when the ram and bed are moved together with the maximum amount of slack being the difference between the extent of relative motion between the bed and ram and the distance moved by the reciprocating member.

4. A crimping machine for attaching terminals to electrical conductors comprising:

an applicator having a bed and a ram relatively movable to operate on a workpiece placed therebetween;

a first tool holder removably attached to the ram;

a second tool holder removably attached to the bed;

the tool holders retaining cooperating crimping dies effective when the bed and ram are moved together, to crimp a terminal onto a conductor; and terminal feed means locatable in any of three quadrants relative to the crimping dies to provide for feeding terminals from a selected one of the three quadrants and mechanically coupled to both the bed and ram and removably attached to the applicator for supplying terminals seriatim and in synchronism with the relative movement of the ram and bed to the region between the ram and bed whereby independent toolless replacement of any of the tool holders and feed means may be effected to accommodate a specific conductor and terminal combination.

* * * * *